United States Patent [19]

Curtis et al.

[11] Patent Number: 4,646,475

[45] Date of Patent: Mar. 3, 1987

[54] ABRASIVE BELT SURFACE GRINDER AND METHOD

[75] Inventors: William I. Curtis, Middleburg Heights; Paul H. DeRamo, Chesterland, both of Ohio

[73] Assignee: Harsco Corporation, Camp Hill, Pa.

[21] Appl. No.: 760,951

[22] Filed: Jul. 31, 1985

[51] Int. Cl.[4] ..... B24B 21/02; B24B 5/313

[52] U.S. Cl. ..... 51/145 T; 51/237 T; 51/108 R

[58] Field of Search ..... 51/143, 144, 145 R, 51/108 R, 122, 123 R, 134, 237 T

[56] References Cited

U.S. PATENT DOCUMENTS

| | | | |
|---|---|---|---|
| 2,242,158 | 5/1941 | Wasson et al. | 51/237 T |
| 3,816,998 | 6/1974 | Grivna et al. | 51/145 T |
| 4,481,742 | 11/1984 | Shimizu et al. | 51/1234 |
| 4,546,573 | 10/1985 | Shiba et al. | 51/235 |

*Primary Examiner*—Robert P. Olszewski
*Assistant Examiner*—Maurina Rachuba
*Attorney, Agent, or Firm*—Baldwin, Egan & Fetzer

[57] ABSTRACT

An abrasive grinding machine and method which includes and endless power driven grinding belt mounted on a frame of the machine and a movable workholder on the frame adapted for holding workpieces to be surface ground by the endless grinding belt. A reciprocal power mechanism is provided for moving the workholder back and forth relative to the belt for exposure of the workpieces on the workholder to the abrasive action of the belt. Elevating means is provided for raising and lowering the workholder relative to the belt, and an indexing mechanism is provided for indexing the workholder about a generally vertical axis relative to the belt, thus providing for control of and more even grinding of the surfaces of the workpieces on the workholder.

8 Claims, 8 Drawing Figures

ABRASIVE BELT SURFACE GRINDER AND METHOD

This invention relates in general to abrasive grinding machines and method, and more particularly to an abrasive grinding machine and method embodying an endless abrasive belt for accomplishing a surface grinding function together with a workholder which is adapted for back and forth movement relative to the powered grinding belt, for accomplishing the surface grinding operation on workpieces or parts mounted on the workholder, and wherein the workholder is capable of being indexed about a generally vertical axis so as to present different positions of the workpieces on the workholder, to the grinding belt, thus promoting more uniform belt wear, flatter ground surfaces on the workpiece surfaces and redistribution of the grinding pressure per unit area of the respective workpiece surface.

BACKGROUND OF THE INVENTION

Grinding machines utilizing powered endless grinding belts are well known in the art. However, the workholders in such prior art grinding machines are generally movable in a single generally linear path relative to a powered grinding belt, and are not indexable or rotatable about an axis of the workholder. This results in generally non-uniform belt wear for the grinding belt mechanism, and oftentimes non-uniform ground surfaces on the workpieces being processed by the machine. By providing a feature of selective indexing of a workholder relative to the abrasive grinding belt, flatter ground surfaces on the workpieces may be provided, together with a breaking up of the grinding scratch pattern on the workpieces, and redistribution of the unit area grinding pressure. This is particularly true of workpieces mounted on the workholder which have generally non-uniform surface areas to be ground.

SUMMARY OF THE PRESENT INVENTION

The present invention provides an abrasive grinding machine and method, with the machine having a main frame with a endless powered grinding belt mounted thereon, and there being provided a subframe mounting the workholder thereon, and including means for moving the subframe vertically relative to the main frame and the abrasive grinding belt, thus providing for altering the vertical position of the workpieces on the workholder relative to the belt. The workholder is movable on the auxiliary frame back and forth relative to the grinding belt, thus providing for the surface grinding capability of workpieces mounted on the workholder, and means is provided for selectively indexing the workholder about a generally vertical axis preferably at the end of each workholder stroke, thus providing for more uniform ground surfaces on the workpieces or parts being abrasively ground by the belt.

Accordingly, an object of the invention is to provide a novel abrasive grinding machine utilizing an endless grinding belt for surface grinding of workpieces or parts.

Another object of the invention is to provide a novel abrasive grinding machine of the latter type which includes a reciprocal workholder movable back and forth relative to the grinding belt of the machine, and operative to expose workpieces on the workholder to the abrasive action of the belt, and which includes means for indexing the workholder about a generally vertical axis, thus reorienting the parts on the workholder relative to the belt to promote more uniform ground surfaces thereon as well as more uniform belt wear.

A still further object of the invention is to provide a grinding machine of the latter type which includes means for moving the workholder in generally vertical directions relative to the grinding belt, and wherein the indexing of the workholder relative to the belt will occur automatically at the end of each stroke of the workholder.

A still further object of the invention is to provide a novel method of surface grinding of workpieces utilizing an abrasive endless grinding belt, and including the indexing of the workholder relative to the belt, so as to reorient the parts being surface ground by the belt during exposure to the belt, thereby promoting more uniform ground surfaces thereon as well as more uniform grinding belt wear.

Other objects and advantages of the invention will be apparent from the following description taken in conjunction with the accompanying drawings wherein:

BRIEF DESCRIPTION OF THE DRAWINGS

FIG. 6 is a sectional, partially broken, side elevational view of the grinding machine of FIGS. 1–5, illustrating in somewhat greater detail the operating components thereof;

DESCRIPTION OF PREFERRED EMBODIMENT

Figure 4:
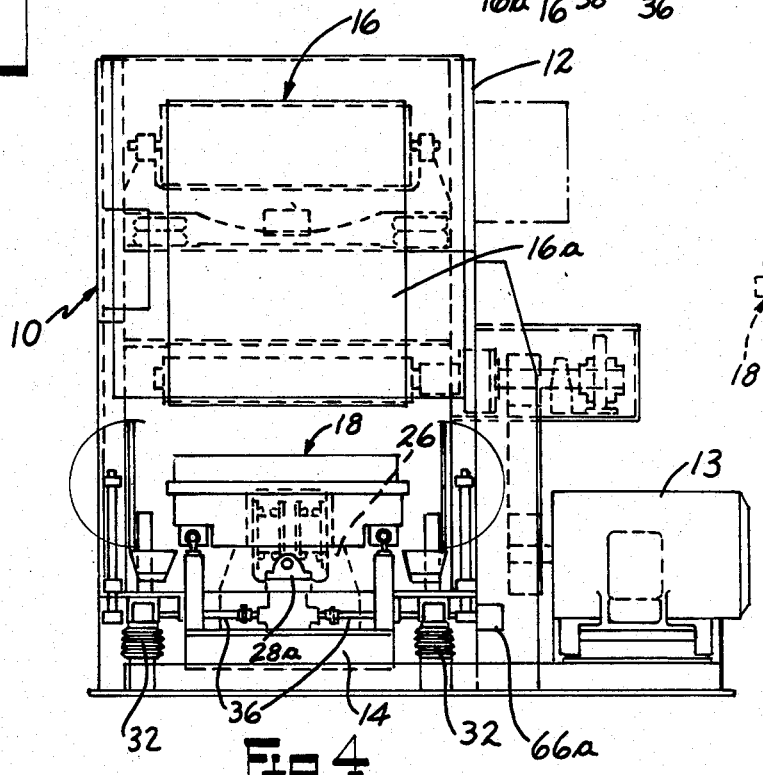
FIG. 4 is an end elevational view of the grinding machine of FIGS. 1–3 taken from the right hand end of FIG. 2.
Figure 5:
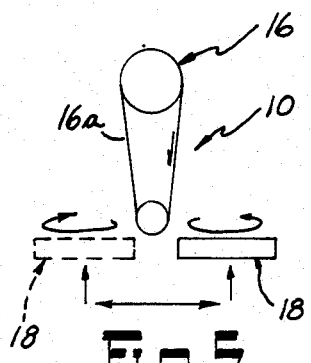
FIG. 5 is a diagrammatic illustration of the indexing movement of the workholder table of the machine relative to the endless abrasive grinding belt thereof.
Figure 1:
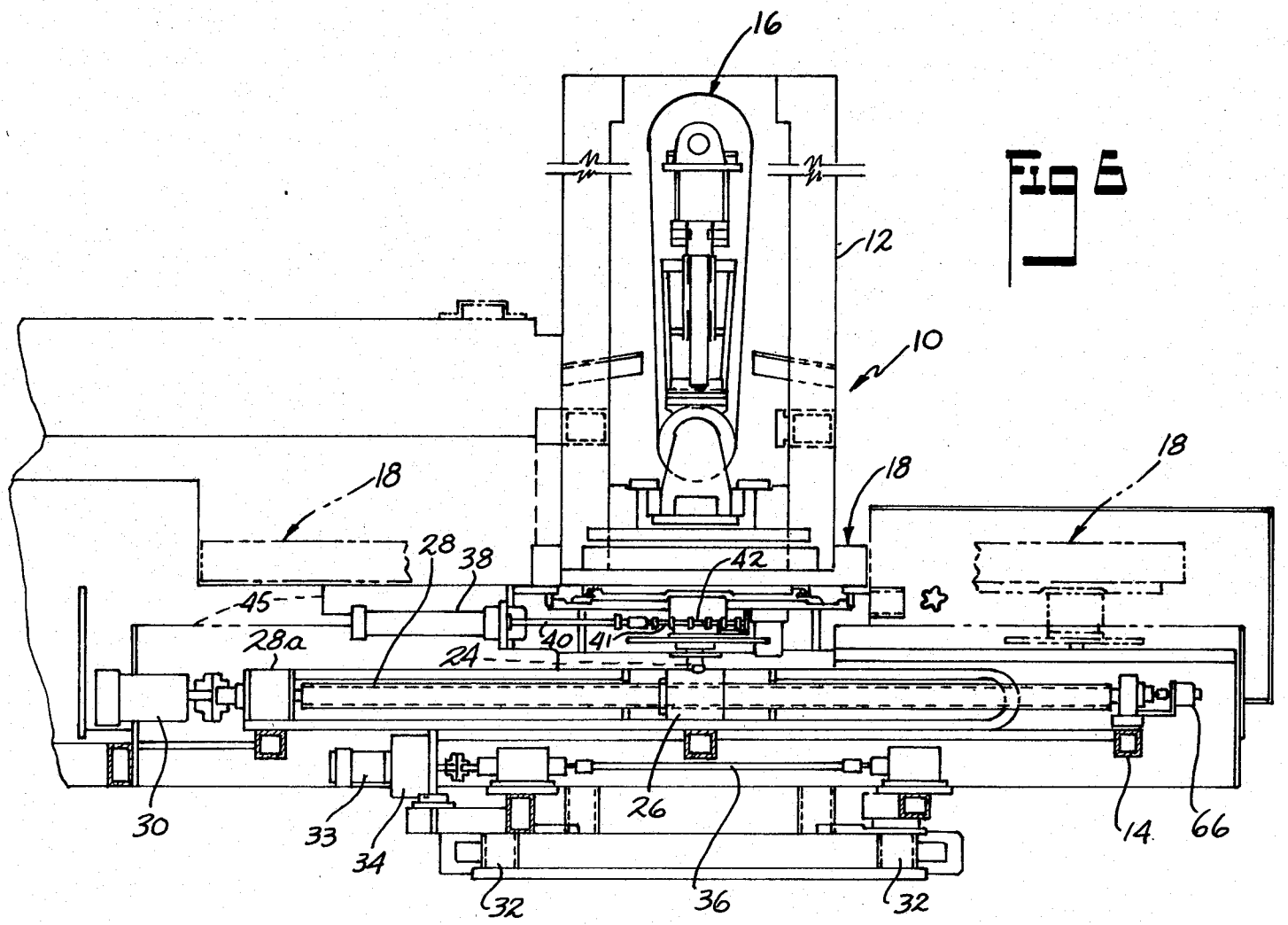
Figure 7:
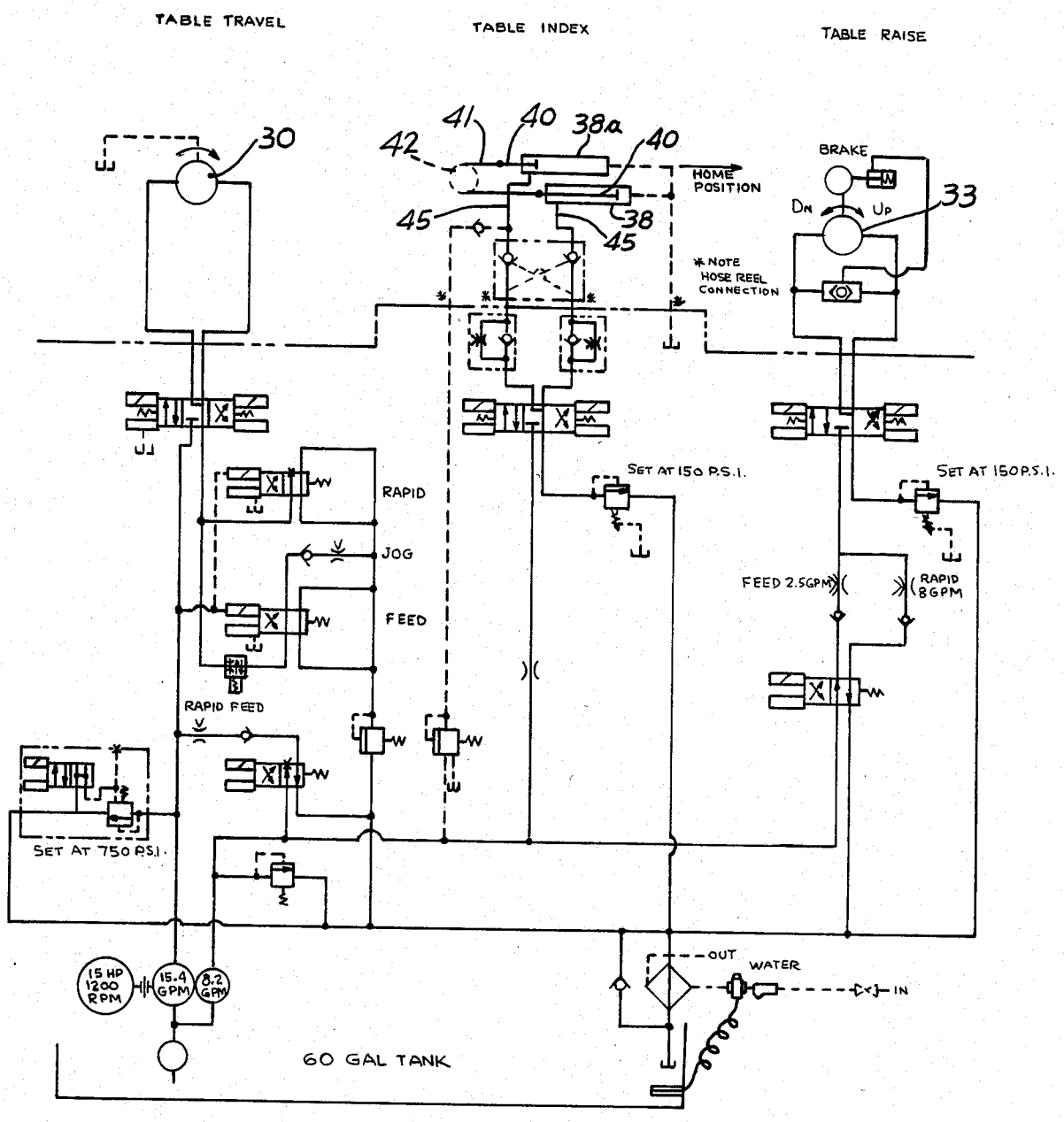
FIG. 7 is a schematic of a hydraulic system for the machine for moving the workholder table longitudinally relative to the grinding belt, for indexing the workholder table about its vertical axis relative to the grinding belt, and for moving the workholder table vertically relative to the grinding belt.

Referring now again to the drawings, there is illustrated a surface grinding machine 10 comprising a main frame 12, a movable auxiliary or subframe 14, and an endless adjustable grinding belt mechanism 16 mounted on the main frame 12 and oriented in generally vertical fashion. The grinding belt mechanism may be of conventional known construction and in the embodiment illustrated, is powered by an electric motor 13 (FIG. 4) operatively coupled to the grinding belt mechanism.

Figure 1:
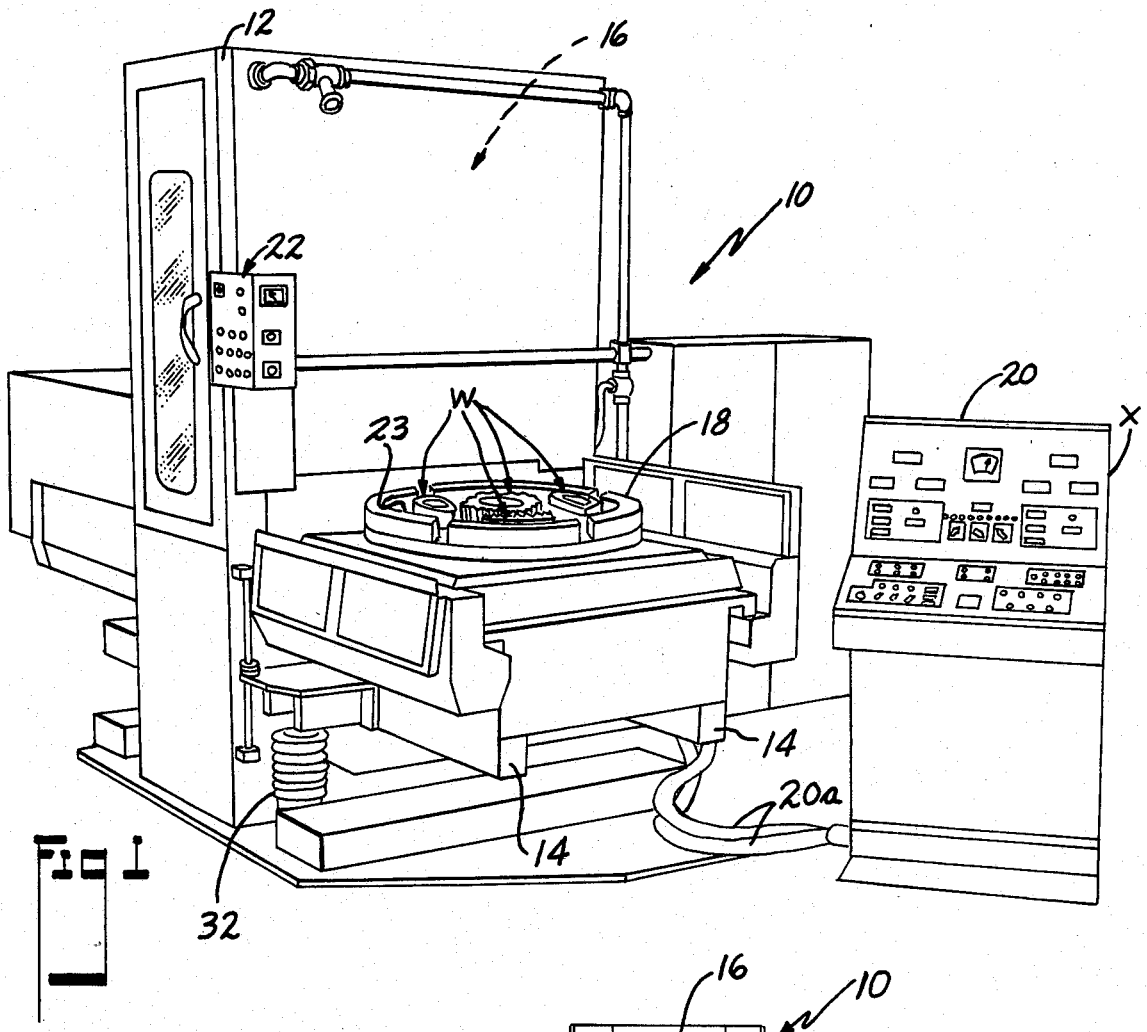
FIG. 1 is a perspective view of an abrasive belt grinding machine embodying the invention.

The auxiliary or subframe 14 supports a longitudinally movable workholder table 18 thereon, with the table being also adapted for indexing rotation about a generally vertical axis, and with such table being adapted for mounting workpieces w (FIG. 1) thereon for presentation to the abrasive action of the endless power driven grinding belt mechanism 16.

The auxiliary frame 14 is movably mounted on the main frame 12 for vertical movement relative thereto and relative to the grinding belt mechanism 16, so as to provide for incremental surface grinding of the work parts w during back and forth or longitudinal reciprocal movement of the workholder table 18 relative to the grinding belt 16.

A control console 20 may be provided remote from the machine proper, and coupled thereto by control cables 20*a*, for controlling the operation of the machine in its function of surface grinding of parts. Both manual and automatic controls may be provided on console 20 for controlling operation of the machine, and as will be hereinafter described. A control panel 22 may also be provided on the machine proper and containing manual controls similar to those on console 20, whereby an operator can manually control the operation of the machine from the latter rather than from the remote console 20.

Figure 2:
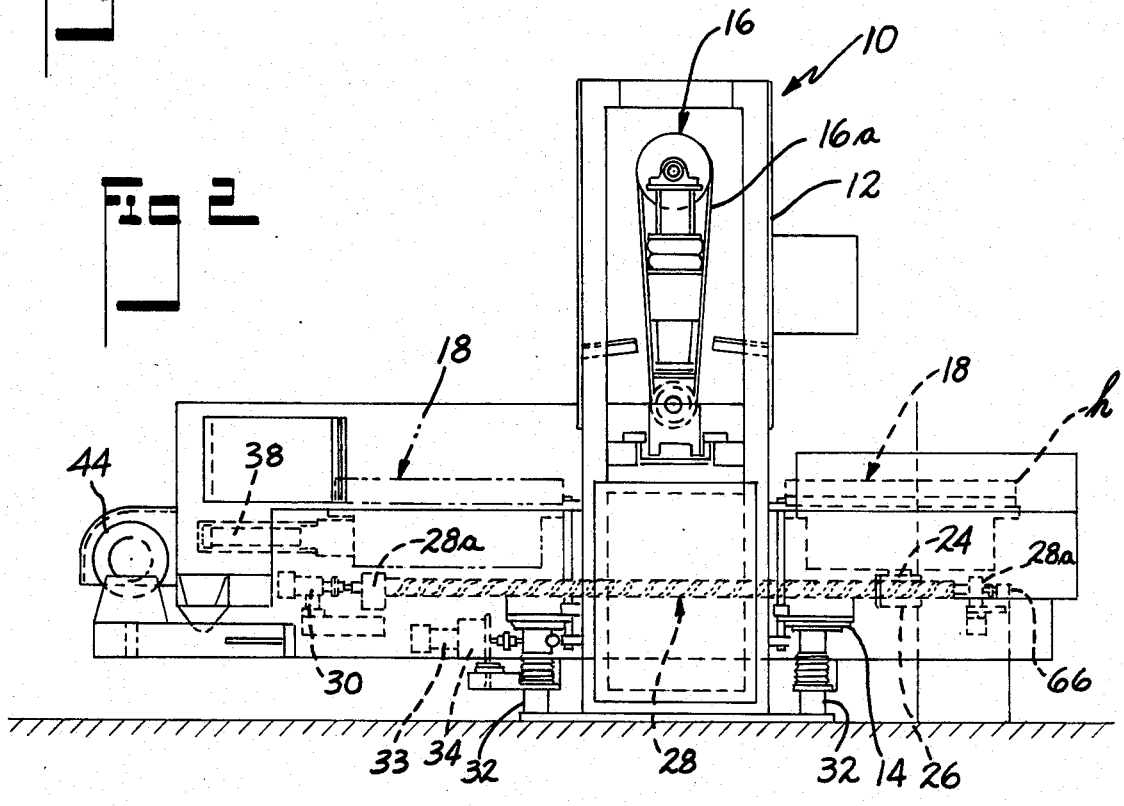
FIG. 2 is a reduced size generally diagrammatic side elevational view of the grinding machine of FIG. 1; in phantom lines there is shown the alternate fully moved position of the workholder table (on the left hand end of FIG. 2)

The workholder table 18 comprises a support surface 23 which has fixtures (not shown) thereon for clamping or locking the workpieces w to the surface of the table. Such table in the embodiment illustrated is provided with a vertical column 24 (FIG. 2) mounted on a nut 26 which in turn coacts with a rotatable worm 28, mounted on bearings 28*a* on the subframe 14, with there being provided a hydraulic power system 30, for rotating the screw 28 both clockwise and counterclockwise and thus causing movement of the nut 26 and mounted workholder table 18 generally horizontally in longitudinal directions relative to the coacting screw 28 and to the subframe 14 and grinding belt 16 on main frame 12.

The subframe 14 is adapted for vertical movement relative to the main frame 12 and mounted grinder apparatus 16, and in this connection there is provided four jack screws 32 (FIG. 2) which support the subframe 14, and upon actuation of the jack screws, the latter raise the subframe 14 and associated workholder table 18 relative to the main frame 12 and mounted belt grinder mechanism 16. Jack screws 32 are adapted for actuation by reversible hydraulic motor 33 and power transmission assembly 34 which are attached to the four jack screws by means of rotatable shaft mechanism 36, thus ensuring uniform actuation of all jack screws simultaneously, and therefore balanced raising and lowering of the subframe 14 and workholder table 18 relative to the main frame 12 and grinder apparatus 16.

Figure 3:
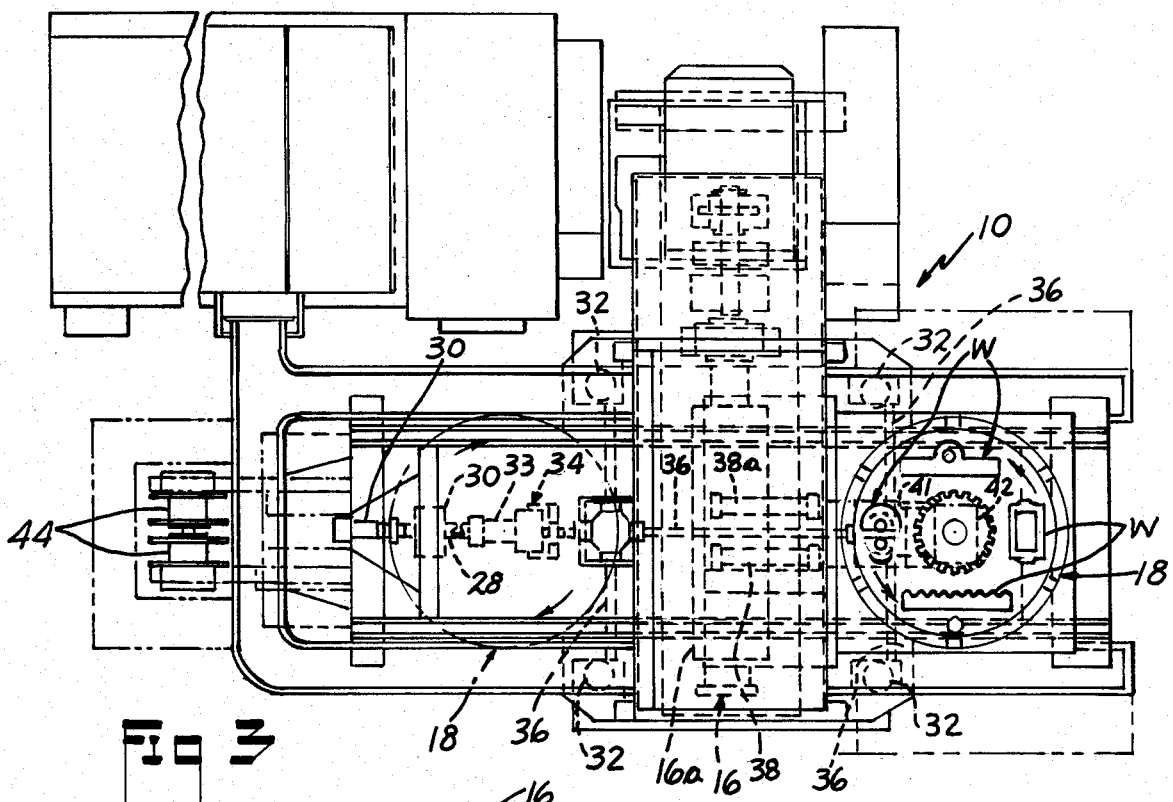
FIG. 3 is a partially broken top plan view of the grinding machine of FIGS. 1 and 2, with phantom lines again showing the aforementioned alternate position of the workholder table as moved relative to the grinding belt.

Rotation of the workholder table 18 about the vertical axis of column support 24 is accomplished in the embodiment illustrated, by means of two opposing hydraulic reciprocal motor units 38, 38*a* (FIGS. 2 and 3), the piston rods 40 of which are connected to a chain 41 (FIG. 6) wrapped around a sprocket 42 (FIG. 6), with the sprocket being attached to the workholder table. By providing for pressurized fluid to flow into one cylinder of one of the motor units and out of the other, this causes the piston rod on said one cylinder to extend and the piston rod on the cylinder of the other motor unit to retract, causing the chain to move or rotate the sprocket 42 and thus turn the workholder table 18. By controlling in which direction the pressurized fluid, which in the embodiment illustrated is hydraulic fluid, is directed into the cylinders, the table can be rotated in either direction for approximately 180 degrees.

Motor units 38, 38*a* are thus connected to and move with the workholder table 18 during the latter's longitudinal reciprocal movements, and in this connection spring loaded reels 44 may be provided for reeling up and extending the flexible fluid power lines 45 supplying motor units 38, 38*a* with pressurized fluid.

Figure 8:
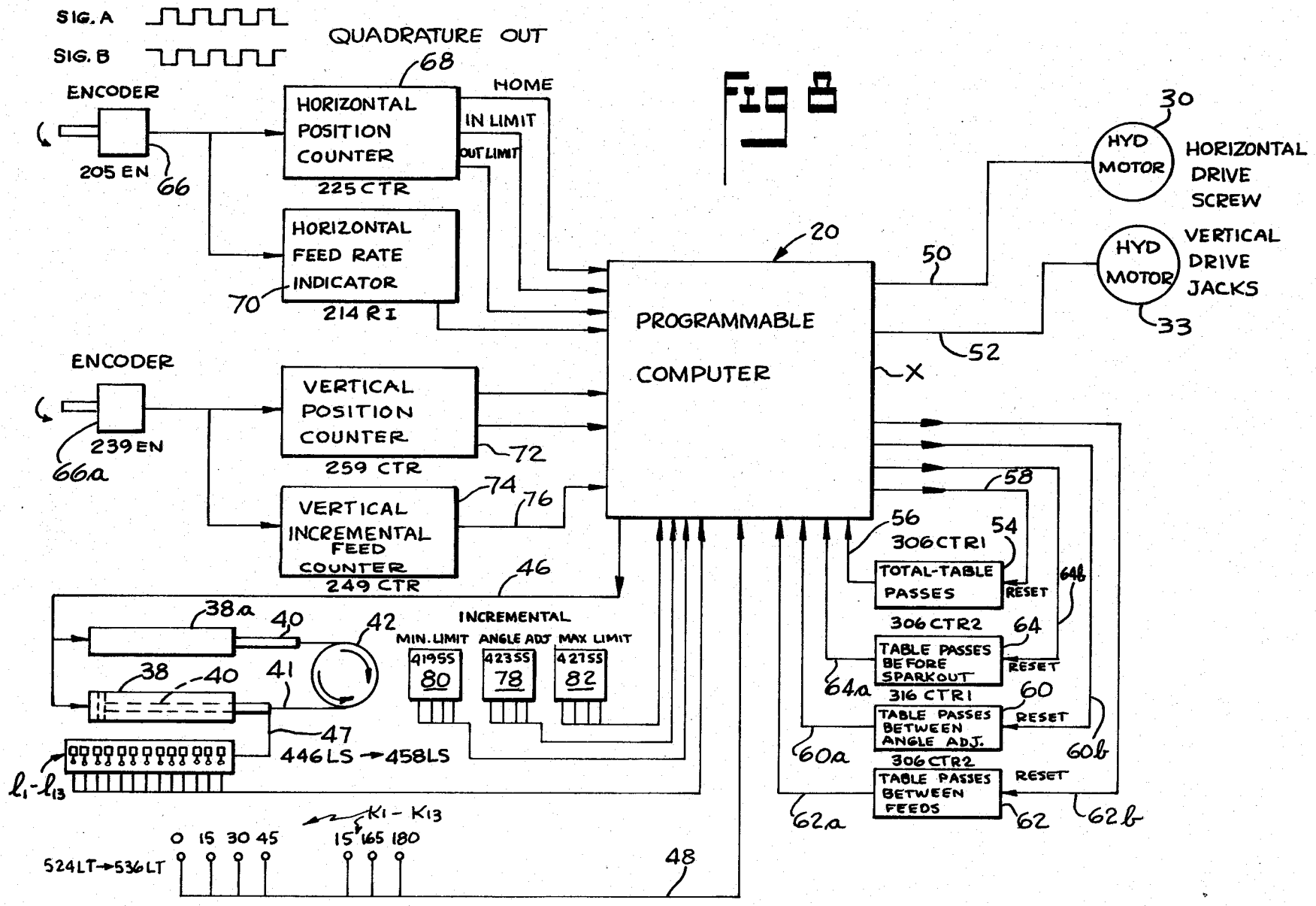
FIG. 8 is a simplified schematic of a programmable control circuit of the machine for automatically controlling the reciprocal movement of the workholder table, the indexing movement of the workholder table, and the vertical movement of the workholder table, relative to the grinding belt section of the machine.

Referring now in particular to FIG. 8, the computer X of console 20 has a signal output as indicated at conduit 46 which connects to aforementioned hydraulic cylinders 38 and 38*a*, the latter as aforementioned being interconnected to sprocket 42 connected to the workholder table 18.

An actuator, schematically depicted at 47, is attached to the piston rod of cylinder 38, and which is adapted to actuate sequentially a group or series of limit switches, identified as $1_1$–$1_{13}$, as the said rod 40 moves into or out of its cylinder 38.

The limit switches $1_1$–$1_{13}$ are disposed in equal spaced relationship and in such dimensional relationship to the sprocket 42 that upon completing one or a part of one complete rotation of said sprocket, all of the limit switches $1_1$–$1_{13}$ will be sequentially actuated. In this manner, as will be realized, one of the limit switches will be actuated as the table 18 is rotated a predetermined angular distance from the last previously actuated limit switch. In this manner, the position to which the table 18 has been rotated may be readily determined at any time during the operation of the grinding machine.

In the present embodiment of control, the table 18 is intended to be rotatable 180 degrees in either direction from a 0 degree reference position, and in increments of 15 degrees. After the maximum limit of indexing set by the controls is reached by the workholder table, the table will automatically reverse and make automatic indexing adjustments in the reverse direction back to its starting position, thus automatically varying the positional presentation of the workpieces on the workholder table to the grinding belt 16*a* of the grinding section 16 of the machine.

A series of lamps identified at $k_1$–$k_{13}$ are connected by conduit 48 to computer X and are individually actuatable to provide a visual signal of the arcuate distance to which the workholder table 18 has been rotated away from the aforesaid 0 degree reference position.

As also seen in FIG. 8, the computer X has signal outputs on conductors 50 and 52 connectable to the hydraulic motors 30 and 33 respectively which are operable, as will be later described in greater detail, to cause actuation of said motors 30 and 33 and move the table 18 longitudinally and vertically respectively between the limit positions preset by the operator.

The computer X is also seen to have additional input signals now to be identified.

A suitable counter 54 such as counter Model 306 CTRI made by Dynapar Corporation of Gurnee, Ill. may be utilized to provide a grinding program having a predetermined number of hozizontal passes of the table 18 beneath the grinding belt 16*a* of grinder section 16. As seen, counter 54 is connected by conductor 56 to the computer X, and being operable to provide an input digital signal into the computer X and result in providing for a preselected number of actuations of the hydraulic motors 30, 33 in a grinding program for the horizontal reciprocable table 18. Counter 54 is also seen to be connected by conductor 58 whereby a suitable reset signal provided by the computer X at the completion of the selected number of horizontal passes of the table, effective to reset said counter 54, to await the next program.

In like manner, counter 60, which may be Model 316 CTRI made by Dynapar Corporation, is similarly operable to provide for a predetermined number of reciprocal horizontal passes of the table 18 per each angular adjustment of the table by the hydraulic motor units 38, 38*a*.

Another counter 62 which may be Model 306 CTR2 of the Dynapar Corporation, is seen connected to the computer X by conductors 62*a*, 62*b* and intended to provide a digital signal input to the computer whereby the table may be adjusted vertically by the jack screws 32 after completion of a preselected number of horizontal passes of the table 18.

A suitable digital counter identified at 64 may also be connected to computer X by conductors 64*a* and 64*b* and capable of providing a suitable digital signal representing the number of reciprocal passes undertaken by the table 18 before what is referred to in the art as "spark out" (i.e., the number of passes it takes for the table before the material being removed by the grinding belt to be so minimal as not to provide an ignited "spark" of material). This signal input can be useful to establish a minimum number of horizontal passes of the table for any particular type of metallic material.

Each of the counters 54, 60, 62 and 64 is provided with a reset signal from computer X through the separate conductors 58, 60*b* 62*b* and 64*b* to reset each respective counter at the conclusion of a work cycle to await the next program.

The horizontal reciprocal movement of the workholder table 18 and the vertical and rotational adjustment of said table, may be individually and automatically controlled by a programmable control now to be described.

In FIG. 8, there is schematically shown in its entirety the programmable control which includes an optical encoder 66 of the type identified as a 205EN encoder made by the aforementioned Dynapar Corporation of Gurnee, Ill.

Encoder 66 is suitable drivably connected to the rotatable screw 28 that drives the table 18 horizontally. As the lead screw 28 turns, this optical encoder 66 generates a pulse train of the type illustrated in FIG. 8 as Sig A or B which is then applied to a counter 68 which may be a Model 225CTR counter made by Dynapar Corporation. This control 68 uses either pulse train A or B to identify the horizontal location of the table 18 and hence the workpiece or workpieces w supported thereon. When the encoder 66 is actuated in one direction by the lead screw rotating in a first direction, as for example to move the table 18 from left to right with respect to FIGS. 2 and 6, the pulse train, which may be Sig A, is accumulated in counter 68. As will be understood by those skilled in this art, if the table 18 is initially located at a "home position" (e.g., the position of the table illustrated on the right in FIG. 2) and is then moved away from said position, the number of pulses generated in said pulse train (Sig A) is directly related to the linear distance the table has been moved.

When the encoder 66 is actuated by the rotation of the lead screw 28 in one direction it provides a pulse train such as Sig A, and when it is actuated by the lead screw rotating in the opposite direction, it generates pulse train Sig B.

When pulse train (Sig A) is applied to counter 68, it counts "up" whereas upon receiving pulse train (Sig B) said counter 68 counts "down".

As will also be realized by those skilled in the art, the rotational speed of the lead screw 28 likewise determines the pulse rate of the pulse train (i.e., the higher the velocity of the lead screw, the greater is the number of pulses generated per unit of time).

As seen in FIG. 8, the pulse train generated by encoder 66 is also connected to a horizontal feed rate indicator 70, such as Model 214RI indicator made by Dynapar Corporation. This indicator receives the pulse train from encoder 66 and provides a visual indication of the linear velocity of the table as it is moved in either horizontal direction.

As seen in FIG. 8, the horizontal position counter 68 has three output signals identified respectively as "home", "in limit" and "out limit".

The home signal is a signal which identifies the location of the table 18 when it reaches either its "home" or at rest positions on the machine, such as the position to which the table may be moved for loading a workpiece thereon. A typical "home" position for table 18 is depicted at the right hand end of FIG. 2. A similar home position may be located at the left hand end of the machine shown in FIG. 2.

The "in limit" signal is the signal which identifies the position occupied by the table when it reaches the end of its inner path or direction of travel. For example, looking at either FIG. 2 or FIG. 6, and assuming the table is moved first from right to left passing under the moving grinding belt 16*a* and then reciprocally in the opposite direction, from left to right, the "in limit" position is the point momentarily occupied by the table at the end of the right to left stroke or longitudinal movement of the table immediately before the reverse movement thereof is initiated.

Likewise, the "out limit" position is the point at the end of the left to right stroke or movement of the table immediately prior to the beginning of the next right to left stroke. It will be noted that the "in limit" position may be selected to be within the outer limits of the possible table movement or spaced inwardly on the machine of the home position "h" (FIG. 2) of the table 18.

The above described three output signals of the horizontal counter 68 are connected to programmable computer X as seen in FIG. 8 which, as will be later explained, is programmed using said signals to automatically control the cycling of the horizontal reciprocal movement of the table 18 and the workpieces w thereon.

For monitoring vertical movement of the table by the jack screw 32, a similar optical encoder 66*a* which may be Model 239EN encoder as made by the Dynapar Corporation, is suitably connected to drive shaft 36 (FIG. 4) for the jack screws 32. This encoder 66*a* operates like the horizontal encoder 66 to produce a pulse train like Sig A or B for identifying the vertical positioning of the table 18 with respect to the grinding belt 16*a*. Sig A pulse train may be generated by encoder 66*a* when the table 18 is moving upwardly toward the belt 16*a*, and Sig B pulse train may be generated when the table 18 is being lowered or moving down and away from the aforesaid grinding belt.

Pulse train Sig A or B is applied to vertical position counter 72 which provides a visual digital signal of the position occupied by the table. This counter 72 may also be of the type identified as Model 259CTR counter of Dynapar Corporation.

The rate of vertical movement may also be monitored by a counter identified as a vertical incremental feed counter 74 typical of which is Model 249CTR of Dynapar Corporation and which provides a signal indicating the incremental rate of vertical movement of the table per unit of time as it moves toward or away from the grinding belt 16*a*.

With the above control system, a typical workpiece grinding program will now be described.

It is assumed that the operator will know the initial and desired finish thicknesses of the workpiece w so that the computer X can be programmed to automatically control the horizontal reciprocation of the table 18 past the grinding belt, the vertical movement required of the table 18 to progressively raise the workpiece (or workpieces) w as it is being ground by the belt to finish thickness, and to periodically rotate or index the table during the grinding process in order to assure a substantially even removal of material from the workpiece.

The operator will decide the total number of passes that is desired for the table to make past the grinding belt without the table indexing, the number of passes between vertical adjustments of the table to raise the workpiece, and the vertical dimension of said adjustments, and the number of passes between angle adjustments of the table.

This information is programmed into the computer X. As will be understood by knowing the configuration of the pulse train Sig A and B generated by the horizontal encoder 66 and vertical encoder 66*a*, the horizontal and vertical movement of table 18 required for the particular grinding process may be readily determined and programmed into the computer.

Hydraulic motor 30 may then be actuated to position the table 18 at its outermost "home" position h at one end of the frame 14. This is the position to which the table 18 returns at the completion of a workpiece grinding cycle.

The workpiece (or workpieces) w may then be placed onto the table 18 and securely fastened thereto by suitable clamps or fixtures.

The horizontal position counter 68 is then preset to provide a "home signal input" to computer X which stores the same in its memory to await recall for returning the table to its "home position".

The table 18 is then caused to move horizontally to the opposite side of the grinding belt 16*a* to a position where the workpiece w is clear of said belt as the table 18 is rotated thereat. This position is identified by counter 68 by an "in limit signal" which is applied to computer X being operable to limit the inbound movement or stroke of the table.

The table is then reversibly actuated to move to the opposite side of the grinding belt 16*a*, and is stopped at a point adjacent to and spaced inwardly from the "home position" where the workpiece w is still at a suitable distance away from the belt 16*a* sufficient to enable the table to be angularly rotated or indexed without the workpiece being engaged by the grinding belt 16*a*.

This position is identified by counter 68 as being an "out limit signal" which is then fed to computer X to program said computer so as to limit the outbound movement or stroke of the table 18 during the grinding cycle.

The table 18 is then actuated to position the workpiece w directly beneath the grinding belt 16*a*, and the table may then be raised by actuating hydraulic motor 33 whereby to drive the jack screws 32 until the top surface of the workpiece w is spaced a suitable preferably minimal distance under the belt. This position is identified by vertical position counter 72 by an "initial vertical position" signal that is applied to computer X to identify said position.

The operator selects on counter 74 the "incremental distance" that the table 18 will be raised at the completion of each series of passes of said table under the grinding belt and this "incremental distance signal" is applied via conductor 76 to the computer X.

The operator also selects the desired angular extent of rotatable adjustment or indexing to be made between each series of passes of the workpiece past the grinding belt in increments as aforementioned in the embodiment illustrated of 15 degrees.

This adjustment is then programmed into the computer X by switching device 78 which is intended to trigger the computer at the end of each series of passes to provide for rotatably indexing the table 18.

Also shown in FIG. 8 are additional switching devices 80 and 82 which are present as a "minimum limit" and a "maximum limit" respectively which are connected to the computer X and provide minimum and maximum indexing limits for the table for the particular grinding program.

The table may be returned to its "home position" h and computer X is then actuated to initiate the grinding cycle or process.

The table with the workpiece or workpieces thereon thus programmed moves or passes under the grinding belt whereby material is progressively removed from the workpiece reciprocating between the "out limit" position and then reversing to travel to the "in limit" position. At the completion of the preselected number of passes including "spark out" passes as above referred to, the table 18 returns to its "in limit" position, and the table is rotatably adjusted or indexed and also raised the incremental distance as determined by the aforementioned "incremental distance signal".

The rotatable adjustment or indexing or the table, as aforementioned, is preset by switching device 78 and the table moves to its adjusted position and the horizontal reciprocal movement of the table is repeated.

This process repeats at the completion of each series of horizontal passes of the table 18 until the "finish thickness" of the workpiece w is obtained, at which time the computer programs the movement of the table 18 back to its "home position" to await the next grinding process.

From the foregoing description and accompanying drawings it will be seen that the invention provides a novel surface grinding machine and method, which includes means for indexing the workholder about an axis thereof and relative to an endless grinding belt of a powered grinding mechanism, for providing for more even grinding of the surface of workpieces mounted on the workholder, and providing for more even wear on the endless grinding belt. The invention also provides a machine of the latter type which includes a control system for automatically controlling longitudinal reciprocal movement of the workholder relative to the grinding belt, vertical movement of the workholder relative to the grinding belt, and rotative indexing movement of the workholder relative to the grinding belt for a grinding cycle.

The terms and expressions which have been used are used as terms of description and not of limitation, and there is no intention in the use of such terms and expressions of excluding any equivalents of any of the features shown or described, or portions thereof, and it is recognized that various modifications are possible within the scope of the invention claimed.

We claim:

1. A machine for grinding including an endless power driven grinding belt and a workholder adapted for holding workpieces to be surface ground by said belt, means for moving said workholder in reciprocal fashion relative to said belt and operative to expose workpieces on said workholder to the abrasive action of said belt, and means for indexing said workholder relative to said belt about a generally vertical axis, the last mentioned means including a pair of opposing powered reciprocal motor units each of which includes a reciprocal actuating rod connected to a flexible member which is operatively connected to said workholder, means for controlling the extension of said rod of one motor unit while retracting said rod of the other motor unit thus causing said flexible member to rotatably move said workholder and control in which direction said workholder rotates, one of said rods including a rod operated actuator coacting therewith and connected to means adapted to visually indicate the rotative position of said workholder in degrees.

2. A machine in accordance with claim 1 wherein said indexing means includes means for automatically indexing said workholder means through predetermined increments during said reciprocal movement of said workholder relative to said belt, said indexing occurring at the ends of travel of said reciprocal movement.

3. A machine in accordance with claim 2 wherein said indexing means is operable to index said workholder in increments of about 15 degrees about said vertical axis.

4. A machine in accordance with claim 1 wherein said means for moving said workholder in reciprocal fashion comprises a rototable worm mounted on said machine, and a nut secured to said workholder and coacting with said worm so that rotation of said worm causes said reciprocal movement of said workholder.

5. A machine in accordance with claim 2 wherein said workholder comprises a horizontally oriented platform mounted for rotational movement on said generally vertical axis.

6. A machine in accordance with claim 1 wherein said means for causing reciprocal movement of said workholder relative to said belt includes rotatable screw means, and control means coupled thereto with means for controlling the in position location and the out position location of said workholder relative to said belt and at positions sufficiently spaced from said belt to enable said workholder to be indexed rotatably relative to said belt without interference therewith, said locations defining the outermost boundaries of said reciprocal movements of said workholder during the grinding operation.

7. A machine in accordance with claim 1 including means for automatically raising and lowering said workholder relative to said belt, and within predetermined limits.

8. A machine for grinding including an endless power driven grinding belt and a workholder adapted for holding workpieces to be surface ground by said belt, means for moving said workholder in reciprocal fashion relative to said belt and operative to expose workpieces on said workholder to the abrasive action of said belt, and means for indexing said workholder relative to said belt about a generally vertical axis, and wherein said means for indexing said workholder includes a pair of opposing fluid powered piston and cylinder motor units connected to a chain which is wrapped around a sprocket attached to said workholder, means for applying operating fluid to one cylinder and to exhaust it from the other cylinder thus causing the piston rod on one cylinder to extend and the piston rod on the other cylinder to retract, and causing said connecting chain to rotatably move said sprocket, and controlling in which direction the operating fluid to said motor units is applied, one of said piston rods of said motor units including a rod operated actuator which is adapted to indicate the rotative position of the workholder in degrees, and including three controls, one of which is a minimum indexing limit, one a maximum indexing limit, the other an incremental angle adjust limit, said minimum limit control setting the minimum angle that the workholder can rotate, the maximum limit control setting the maximum angle, and the incremental angle adjust control setting the number of degrees that the workholder will turn during said workholder indexing.

* * * * *